United States Patent [19]

Ito

[11] 4,217,138

[45] Aug. 12, 1980

[54] NICKEL ALLOY HEATER IN GLOW PLUG

[75] Inventor: Tsuneo Ito, Nagoya, Japan

[73] Assignee: NGK Spark Plug Co. Ltd., Nagoya, Japan

[21] Appl. No.: 936,553

[22] Filed: Aug. 24, 1978

[30] Foreign Application Priority Data

Aug. 27, 1977 [JP] Japan ..... 52-102881

[51] Int. Cl.[2] ..... C22C 19/03

[52] U.S. Cl. ..... 75/170; 148/32; 219/270

[58] Field of Search ..... 75/170; 148/32, 32.5; 219/270

[56] References Cited

U.S. PATENT DOCUMENTS

| | | | |
|---|---|---|---|
| 2,172,967 | 9/1939 | Boer et al. | 75/170 |
| 3,726,722 | 4/1973 | Foerster et al. | 75/170 |
| 4,061,495 | 12/1977 | Selman et al. | 75/170 |

*Primary Examiner*—R. Dean

*Attorney, Agent, or Firm*—Sughrue, Rothwell, Mion, Zinn and Macpeak

[57] ABSTRACT

A nickel alloy for use in a heater for a glow plug, which comprises pure nickel and 0.05 to 2.0% by weight of a metal such as yttrium, zirconium or ruthenium, which does not form a solid solution with nickel.

7 Claims, 3 Drawing Figures

NICKEL ALLOY HEATER IN GLOW PLUG

BACKGROUND OF THE INVENTION

1. Field of the Invention

This invention relates to a nickel alloy useful in a heater for a glow plug to be mounted on an internal combustion engine such as a diesel engine.

2. Description of the Prior Art

In recent years, automobiles with diesel engines have increased in number. Because diesel engines have the defect that when the engine is cold, a longer time for starting is requried and it is desired to shorten this time. For this purpose, a rapid heating-type glow plug whose temperature is increased by passing a large electric current through the heater must be used. It is important for (a) such a rapid heating-type glow plug to have a large positive coefficient of electrical resistance-temperature to shorten the time for the temperature increase and to prevent breaking physically by melting due to excessive heat; and (b) such a property to be maintained for long periods of time and the coarsening of the crystal grains at high temperatures and high temperature degradation thereof by expansion and shrinkage incident to heating and cooling to be minimized. To meet requirement (a), the heater of the glow plug should have an electrical resistance value at about 800° to 1000° C. (i.e., the practical temperature range for heaters) at least three times higher than that at about 20° C. When a pure metal such as pure nickel (denoting nickel usually containing less than 0.5% by weight of manganese, silicon and cobalt and less than 0.1% by weight impurities) is used as the heater, the crystal grains of nickel become coarser at high temperatures, and thus degradation of the nickel occurs. Moreover, such a pure metal is susceptible to oxidation and is not durable. Also, the strength of such a pure metal at high temperatures is degraded, and breaking tends to occur. Thus, this heater cannot meet requirement (b) mentioned above. When active additive such as chromium is mixed with pure nickel to form a solid solution, the durability of the metal can be retained, but the ratio of the electrical resistance at high temperatures to that at room temperature is below 3, and rapid heating cannot be achieved.

SUMMARY OF THE INVENTION

An object of this invention is to provide a nickel alloy for use in a heater for a glow plug which is free from the problems described above, maintains a large positive temperature electrical resistance coefficient, in which the coarsening of the crystal grains at high temperatures and degradation at high temperatures can be prevented and which is mechanically strong.

It has now been found that a heater which can meet both requirements (a) and (b) above can be obtained by adding to pure nickel 2% by weight or less of a metal element which does not form a solid solution with nickel.

DETAILED DESCRIPTION OF THE INVENTION

A characteristic feature of the invenion is that by causing a suitable amount of crystal grains of a metal element which does not form a solid solution with nickel to be dispersed in the interstices among the crystal grains of pure nickel, the growth in the size or coarsening of the crystal grains of pure nickel at high temperatures e.g., about 1000° C., can be prevented without substantially decreasing the temperature electrical resistance coefficient of pure nickel, and furthermore, this results in an increase in the strength of pure nickel at high temperatures and thus physical breaking of the heater does not appreciably occur.

The present invention thus provides nickel alloy comrising 99.95% to 98.0% by weight nickel and 0.05 to 2% by weight of an additive metal incapable of forming a solid solution with nickel.

Examples of suitable additive metals which can be used are yttrium, zirconium, ruthenium, Misch metal (an alloying additive containing 40 to 50% by weight cerium and 20 to 40% by weight lanthanum and the balance neodymium or the like) and rare earth elements, e.g., lanthanum, cerium, praseodymium, neodymium, etc. These additive metals can be used either alone or in combination. The amount of the additive metal is within the range of 0.05 to 2.0% by weight. If the amount of the additive metal is less than 0.05% by weight no effect on preventing a coarsening in the crystal grains of the nickel alloy is obtained, the breakage tends to occur. On the other hand, if the amount of the additive metal is more than 2.0% by weight, intergranular precipitation occurs at high temperatures e.g., about 1000° C., and degradation is rather accelerated. Furthermore, the nickel alloy becomes too hard, and the metal alloy becomes difficult to work. In addition, the temperature electrical resistance coefficient of the nickel alloy becomes low, and it cannot be used as a heater for a glow plug.

Since the additive metal dispersed among the crystal grains of nickel prevents an increase in the nickel crystal grain size, the crystal grains do not appreciably coarsen and the decrease of the yield point of the nickel alloy is prevented. Hence, degradation and oxidation of the heater can be prevented.

Preferred additive metals are yttrium, zirconium and ruthenium.

The following Example is given to illustrate the invention in greater detail.

EXAMPLE

Figure 1:
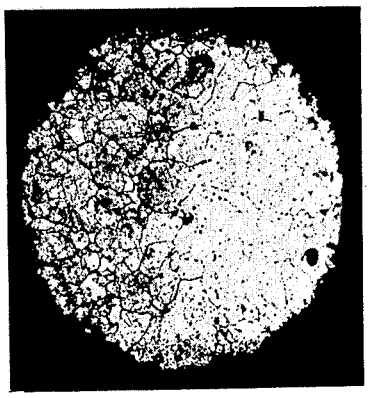
FIG. 1 is a microphotograph of the cross section of Sample No. 1 produced in the Example given hereinafter.
Figure 2:
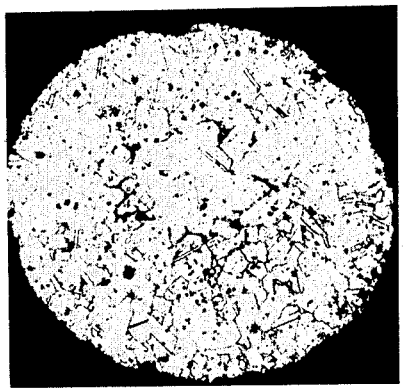
FIG. 2 is a microphotograph of the cross section of Sample No. 2 produced in the Example given hereinafter and, FIG. 3 is a microphotograph of the cross section of Sample No. 3 produced in the Example given hereinafter.
Figure 3:
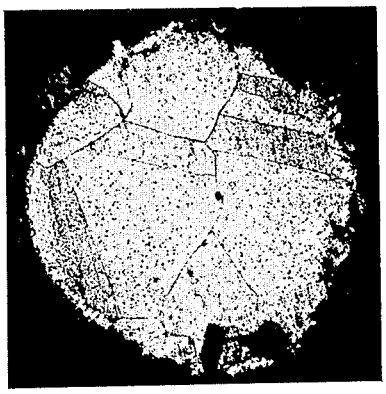

Nickel alloys having the compositions Nos. 1 to 5 shown in Table 1 below were produced by vacuum melting at a vacuum of $10^{-3}$ mmHg and a temperature of about 1600° C. Each of the alloys was processed into a round wire having a diameter of 0.2 mm. The specific electric resistance values at 15° C. of each of the round wires are shown in Table II. Samples Nos. 1, 2 and 5 were each heated at 1100° C. for 10 hours in the air, and microphotographs of the cross-sectional structures of these samples at a degree of magnification of 300 were taken. The microphotographs are shown in FIGS. 1, 2 and 3.

Table I

| Metal | Composition No. 1 | 2 | 3 | 4 | 5 |
|---|---|---|---|---|---|
| additive | Y:0.4 | Zr:1.0 | Ru: 20 | Misch metal :0.2 | Pure Ni |
| Nickel | Remainder | Remainder | Remainder | Remainder | — |

Table II

| Electric Resistance Value Coefficient at Indicated Temperature | Sample No. 1 | 2 | 3 | 4 | 5 |
|---|---|---|---|---|---|
| 15° C. | 8.46* | 8.50 | 8.63 | 8.37 | 8.31 |
| 800° C. | 44.6 | 38.6 | 35.1 | 40.5 | 41.6 |

*in $\mu\Omega$ cm

As shown by the results in Table II, the electric resistance temperature coefficients of the nickel alloys in the Example were scarcely affected and as shown in FIGS. 1, 2 and 3, the coarsening of the crystal grains was markedly less than that which ocurred with pure nickel. Thus, a decrease in the yield point, as well as degradation and oxidation were prevented.

Thus, by adding 0.05 to 2.0% by weight of a metal element incapable of forming a solid solution with nickel to pure nickel, the coarsening of the crystal grains and high temperature degradation can be prevented without impairing the high positive electrical resistance temperature coefficients. Since the nickel alloy has higher mechanical strength than pure nickel, the alloy can be processed easily into a helical shape and a desired pitch, and the alloy is therefore most suitable for use as a heater for a glow plug.

While the invention has been described in detail and with reference to specific embodiments thereof, it will be apparent to one skilled in the art that various changes and modifications can be made therein without departing from the spirit and scope thereof.

What is claimed is:

1. In a glow plug containing a heater therein, the improvement wherein said heater is a nickel alloy consisting essentially of 0.05 to 2.0% by weight of an additive metal incapable of forming a solid solution with nickel selected from the group consisting of yttrium, zirconium, ruthenium, Misch metal, rare earth elements and mixtures thereof, the remainder of said nickel alloy being nickel, said heater being mechanically strong, maintaining a large positive temperature electrical resistance coefficient and not being subject to coarsening of the crystal grains thereof at high temperature or degradation at high temperature.

2. The glow plug of claim 1, wherein the additive metal in said heater is selected from the group consisting of yttrium, zirconium, ruthenium and mixtures thereof.

3. The glow plug of claim 1, wherein the additive metal in said heater is yttrium.

4. The glow plug of claim 1, wherein the additive metal in said heater is zirconium.

5. The glow plug of claim 1, wherein said additive metal in said heater is ruthenium.

6. The glow plug of claim 1, wherein the additive metal in said heater is Misch metal which contains 40 to 50% by weight cerium and 20 to 40% by weight lanthanum, balance neodymium.

7. The glow plug of claim 1, wherein the additive metal in said heater is a rare earth element selected from the group consisting of lanthanum, cerium, praseodymium, and neodymium.

* * * * *